US007018090B2

(12) United States Patent
Moore

(10) Patent No.: US 7,018,090 B2
(45) Date of Patent: Mar. 28, 2006

(54) HOLDING DEVICE FOR HOLDING A BUCKET WHILE MIXING MATERIALS CONTAINED WITHIN BUCKET

(76) Inventor: Ken Moore, 11812 N. Vickeryville Rd., Edmore, MI (US) 48829

( * ) Notice: Subject to any disclaimer, the term of this patent is extended or adjusted under 35 U.S.C. 154(b) by 0 days.

(21) Appl. No.: 10/405,411

(22) Filed: Apr. 2, 2003

(65) Prior Publication Data

US 2003/0189873 A1 Oct. 9, 2003

Related U.S. Application Data

(60) Provisional application No. 60/369,949, filed on Apr. 4, 2002.

(51) Int. Cl.
*A47G 23/02* (2006.01)

(52) U.S. Cl. ..... 366/197; 366/605; 248/146

(58) Field of Classification Search ..... 366/197, 366/605, 213, 207, 209; 248/154, 146
See application file for complete search history.

(56) References Cited

U.S. PATENT DOCUMENTS 592,012 A * 10/1897 Lewis ..... 220/326
1,782,962 A * 11/1930 Hobbs ..... 294/166
2,559,317 A * 7/1951 Perlstein ..... 366/207
2,576,832 A * 11/1951 Gilbson ..... 248/149
2,673,053 A * 3/1954 Kilian ..... 248/153
3,102,707 A * 9/1963 Jacklin et al. ..... 248/146
3,545,709 A * 12/1970 Harvey ..... 248/146
4,042,221 A * 8/1977 Myers et al. ..... 366/146
4,084,701 A * 4/1978 White ..... 211/81
4,877,208 A * 10/1989 Kennard, Jr. ..... 366/605
5,054,733 A * 10/1991 Shields ..... 248/313
5,071,096 A * 12/1991 Hartmann et al. ..... 248/154
5,232,188 A * 8/1993 Troncone ..... 248/154
D367,210 S * 2/1996 McKenny ..... D7/620
6,464,184 B1 * 10/2002 Lytle ..... 248/126

* cited by examiner

*Primary Examiner*—Tony G. Soohoo
(74) *Attorney, Agent, or Firm*—Barbara M. Burns

(57) ABSTRACT

A device for holding a container (bucket) containing material to be mixed without the need for an operator to hold the container comprises a frame having multiple rings. An upper ring and a lower ring are attached to vertical connectors. Horizontal connectors extend from the lower ring across the diameter to position the bottom of a bucket. The vertical connectors are attached on one edge to the lower ring and on another edge to the horizontal connectors connecting the lower ring. The vertical supports are attached on one upper edge to the upper ring with one free edge that forms a fin that extends into the interior diameter of the device. Supports extend from the vertical connectors below the lower ring. Each support has a tapered side terminating in a point. The device sits on the supports. A bucket of material to be mixed is held within the frame of the device. Means for mixing is applied to the material for mixing the material.

5 Claims, 1 Drawing Sheet

HOLDING DEVICE FOR HOLDING A BUCKET WHILE MIXING MATERIALS CONTAINED WITHIN BUCKET

REFERENCE TO RELATED APPLICATION

This application is based on provisional patent application Ser. No. 60/369,940, filed Apr. 4, 2002.

BACKGROUND OF THE INVENTION

The field of the invention pertains to the mixing of materials, such as dry wall materials or paint mixtures and, in particular, to the holding of a device in which the materials are being mixed.

A bucket or device must be held/restrained while mixing drywall slurry or "mud", paint and other mixtures in the bucket. Drywall slurry is mixed by using an electric drill motor with a paddle attached. The bucket is held by and between the mixer's legs.

A problem is that the action of the paddle in the mixture moves the bucket causing the bucket to move and hit the mixer's legs, causing bruising. A need existed for a holder that allows the mixture to be mixed without causing injury or discomfort to the person doing the mixing.

SUMMARY OF THE INVENTION

The invention is a holding device for holding a bucket while mixing materials contained within the bucket. The invention comprises a frame surrounding a bucket into which a bucket is emplaced prior to mixing the contents contained within the bucket.

The frame is comprised from ⅛" thick banding or 16 gauge×1" steel. The frame employs several rings connected by vertical connectors. The vertical connectors are positioned angularly and do not lie flat against the rings. The vertical connectors attach to the upper ring on only one side of the top of the vertical connector with the other edge extending into the interior diameter of the device. The free edge at the top of the connector forms a fin extending in a counter-clockwise orientation.

Horizontal connectors extend across the interior diameter near the lower ring. The horizontal connectors are turned on edge. The rings and connectors of the frame can be welded together or connected by mechanical means, such as nuts and bolts. A bucket is positionable within the device with the bottom of the bucket resting on the horizontal connectors.

A drill can be used to turn a mixing paddle in the mixture. A drill normally is used with the rotation in a clockwise direction. As the mixing paddle mixes material contained in the bucket, some of the rotational force is transmitted to the bucket which also causes the bucket to rotate. The bucket engages the fins which frictionally limit the rotation of the bucket.

Supports or feet having a taper on one side are positioned to extend from vertical connectors below the lower ring. When looking at the device, the taper on each support angles from upper right to lower left as viewed and forms a point. The device rests on the supports engaged to the surface with the point stabilizing and limiting rotation of the device in use.

For a more complete understanding of the present invention, reference is made to the following detailed description when read with in conjunction with the accompanying drawings wherein like reference characters refer to like elements throughout the several views, in which:

DESCRIPTION OF THE PREFERRED EMBODIMENT

Figure 1:
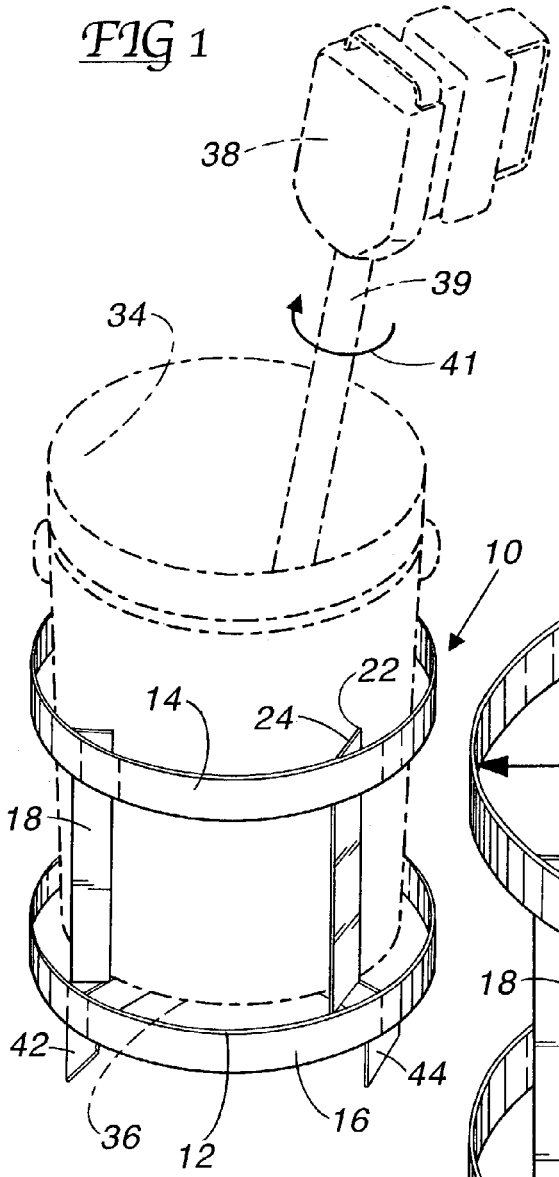
FIG. 1 illustrates an environmental view of the new holding device containing a bucket with a drill extending thereinto.
Figure 2:
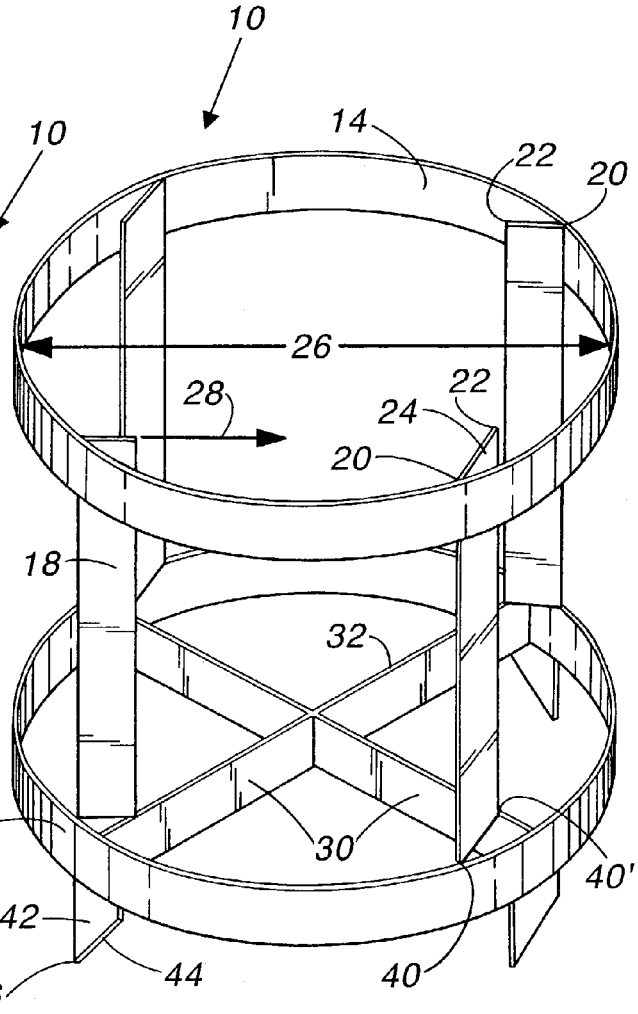
FIG. 2 illustrates a perspective view of the new holding device.

Illustrated in FIGS. 1 and 2, new device 10 comprises frame 12 having multiple rings 14, 16. Upper ring 14 and lower ring 16 are attached by vertical connectors 18.

Vertical connectors 18 are generally longer than wider. A representative single vertical connector 18 will be described. Vertical connector 18 is positioned to attach on one upper longitudinal edge 20 to upper ring 14. Another upper longitudinal edge 22 of vertical connector 18 is free and is not connected to upper ring 14 but forms fin 24 extending into interior diameter 26 of frame 12 (better shown in FIG. 2). Looking generally downwardly into the device 10 fin 24 is shown extending into interior diameter 26 of device 10. Edge 22 of fin 24 extends in a counter-clockwise 28 orientation.

Horizontal connectors 30 extend across the interior diameter 26 near lower ring 16. Horizontal connectors 30 can be positioned on edge with edge 32 upwards. Horizontal connectors 30 position a bucket 34 to hold bottom 36 of bucket 34(shown in phantom lining in FIG. 1). Drill motor 38 can drive mixing paddle 39 (shown in phantom lining in FIG. 1) or other mixing apparatus can be used for mixing materials contained within bucket 34.

Vertical connectors 18 are attached on lower edge 40 to lower ring 16 and on lower edge 40' to upward edge 32 of horizontal connector 30. Lower edge 40' of vertical connector 18 attached to upward edge 32 of horizontal connector 30 is spaced away from lower ring 16.

Supports 42 extend beneath lower ring 16. Each support 42 has tapered side 44 forming point 46 for positioning device 10.

In use, bucket 34 is placed into device 10. Material to be mixed is contained within bucket 34. Mixing device such as drill motor 38 operates mixing paddle 39 placed to the material to be mixed. Drill motor 38 turns mixing paddle 39 generally in a clock-wise direction 41. Thus, bucket 34 would rotate in a clock-wise direction, if any motion occurred. Fin 24 extends into diameter 26 of device and serves to limit rotational motion of bucket 34 during mixing.

It is to be understood that the device herein described could be employed for uses and purposes beyond those for holding a bucket while mixing contents of the bucket.

Having described the invention, many modifications thereto will become apparent to those skilled in the art to which it pertains without deviation from the spirit of the invention as defined in the appended claims.

The invention claimed is:

1. A device for holding a device for containing material to be mixed, the device for holding comprising a frame having a multiplicity of rings forming an interior diameter, the multiplicity of rings having at least an upper ring and a lower ring;

vertical connectors disposed between the multiplicity of rings, the vertical connectors having longitudinal edges, one of said longitudinal edges near an upper edge of the longitudinal edge being attached to an upper ring and another longitudinal attached to an upper ring and another longitudinal edge of the vertical connector at an upper edge being unattached and extending into the interior diameter of the frame, the upper edge of the vertical connector being unattached extends into the interior diameter in a counter-clockwise orientation engaging with the device containing material to be mixed;

horizontal connectors connecting the lower ring a lower edge of the longitudinal edge of the vertical connector being attached to the horizontal connector and another lower edge of the vertical connector being attached to the lower ring; and supports extending beneath the lower ring, wherein the device containing material to be mixed is holdable by the device for holding and material to be mixed contained within the device for holding is mixable during a mixing operation.

2. The device for holding according to claim 1 wherein said supports extending beneath the lower ring each having a tapered side forming a point.

3. The device for holding a device for containing material to be mixed, according to claim 1, wherein the upper edge of at least one vertical connector being unattached extends into the interior diameter in a counter-clockwise orientation engaging with the device for containing material to be mixed.

4. A method of use of the device for holding according to claim 1 for holding a device for containing material to be mixed comprising the following steps placing device for containing material into the device, placing a mixer within the device for containing material thereby engaging material to be mixed within the device for containing material, and operating the mixer thereby mixing the material contained within the device for containing material, the device for holding being usable without the need for an operator to hold the device during use of the device.

5. A method of use according to claim 4 for holding a device for containing material to be mixed further comprising the following step operating the mixing device whereby the device for holding maintains the device for containing material to be mixed in a rotationally controlled orientation, the device being usable without the need for an operator to hold the device for holding during use of the device for holding.

* * * * *